US009375954B2

(12) United States Patent
Anami

(10) Patent No.: US 9,375,954 B2
(45) Date of Patent: Jun. 28, 2016

(54) RECORDING APPARATUS

(71) Applicant: SEIKO EPSON CORPORATION, Tokyo (JP)

(72) Inventor: Akira Anami, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 392 days.

(21) Appl. No.: 13/874,637

(22) Filed: May 1, 2013

(65) Prior Publication Data

US 2013/0293656 A1 Nov. 7, 2013

(30) Foreign Application Priority Data

May 1, 2012 (JP) ..... 2012-104468

(51) Int. Cl.
*B41J 2/01* (2006.01)
*B41J 11/00* (2006.01)
*B65H 5/06* (2006.01)

(52) U.S. Cl.
CPC ..... *B41J 11/006* (2013.01); *B65H 5/062* (2013.01); *B65H 2404/1442* (2013.01); *B65H 2404/1521* (2013.01); *B65H 2407/20* (2013.01)

(58) Field of Classification Search
CPC ..... B41J 13/02–13/076; B41J 11/006
USPC ..... 347/101, 104, 102; 346/134
See application file for complete search history.

(56) References Cited

U.S. PATENT DOCUMENTS 4,990,011 A * 2/1991 Underwood et al. ..... 400/636
6,005,593 A * 12/1999 Yoshinaga et al. ..... 346/134
7,735,991 B2 * 6/2010 Asano ..... 347/102

FOREIGN PATENT DOCUMENTS

| | | |
|---|---|---|
| JP | 62-53259 | 4/1987 |
| JP | 63-60820 | 3/1988 |
| JP | 63-103551 | 5/1988 |
| JP | 06-001492 | 1/1994 |
| JP | 08-151165 | 6/1996 |
| JP | 10-45279 | 2/1998 |
| JP | 2005-112490 | 4/2005 |

* cited by examiner

*Primary Examiner* — Lam Nguyen
(74) *Attorney, Agent, or Firm* — Workman Nydegger

(57) ABSTRACT

A printer includes a first roller and a second roller that pinch a paper sheet therebetween and rotate to transport the paper sheet to the recording unit, a roller support member that support the second roller and is capable of switching between a first state in which the second roller is in contact with the first roller and a second state in which the second roller is moved away from the first roller, and a slider that engages the roller support member and is linearly displaceable in the rotation axis direction of the second roller so as to perform switching by the roller support member.

7 Claims, 13 Drawing Sheets

RECORDING APPARATUS

BACKGROUND

1. Technical Field

The invention relates to a recording apparatus that is capable of easily removing a recording target jammed in a transportation path by using a release structure of a transportation driven roller when the recording target is pinched between a driving roller and a driven roller and transported from a paper sheet transportation unit to a recording unit.

2. Related Art

A recording apparatus (as an example of ink jet printer) includes a paper sheet feeding unit that feeds paper sheets as an example of recording targets when a feeding roller and a feeding tray pinch the paper sheet which are placed on the feeding tray one by one, and a paper sheet transportation unit that precisely feeds the paper sheet which has been fed from the paper sheet feeding unit. A driving roller and a driven roller of the paper sheet transportation unit pinch the paper sheet therebetween and rotate to precisely feed the paper sheet to the recording unit.

When a paper sheet is jammed in a transportation path, operation performance is lowered during removing of the paper sheet jammed between the driving roller and the driven roller. Accordingly, taking into consideration the operation performance during removing of the jammed paper sheet, a configuration for releasing the driven roller from the driving roller (moving the driven roller away from the driving roller) is commonly used.

For example, JP-A-2005-112490 discloses a recording apparatus that has a primary detection unit disposed on an upstream position and a secondary detection unit disposed on a downstream position so as to detect a remaining paper sheet in the transportation path in relation to a driven roller and actuates a release structure of the driven roller based on the detection result.

However, a configuration for releasing a transportation driven roller from a transportation roller to remove the paper sheet jammed in the transportation path uses a roller support member that supports the transportation driven roller and the roller support member is pivotally moved by a cam to switch between a first state in which the both rollers are in contact with each other and a second state in which the both rollers are moved away from each other as shown in JP-A-2005-112490. In this configuration, a large installation space in height direction is required to place the roller support member, a support mechanism for the roller support member, a cam and the like on the upper side of the paper sheet transportation path.

SUMMARY

An advantage of some aspects of the invention is that a recording apparatus is provided that is capable of easily removing a jammed recording target by a user using a release structure of a transportation driven roller, and the release structure that moves the transportation driven roller away from a driving roller is installed in a small space, thereby contributing to reduce the height of the apparatus housing.

According to a first aspect of the invention, a recording apparatus includes a first roller, a second roller that comes into contact with the first roller, a roller support member that supports the second roller and is capable of switching between a first state in which the second roller is in contact with the first roller and a second state in which the second roller is moved away from the first roller; and a slider that is linearly displaceable and engages the roller support member so as to perform switching by the roller support member.

Accordingly, when the slider is linearly displaced, the roller support member moves the second roller to come into contact with the first roller, which causes the first roller and the second roller to pinch the recording target therebetween and transport the recording target to the recording unit. When the slider is linearly displaced in the other direction, the roller support member that engages the slider causes the second roller to move away from the first roller.

That is, the slider that performs linear movement instead of a cam that performs circular movement is used to change the position of the roller support member so as to change the position of the second roller to the first roller between a first state (contact state) and a second state (released state). As a result, the components can be installed in a low-height space, which contributes to achieve a low profile apparatus housing.

According to a second aspect of the invention, in the recording apparatus of the first aspect, the first roller is a driving roller and the second roller is a driven roller that comes into contact with the first roller from the lower position. The apparatus housing often has a dead space under the transportation unit. According to the second aspect, since the driving roller is disposed at an upper position and the driven roller is disposed at a lower position, the slider can be positioned in the dead space. Therefore, in addition to use of the slider to change the position of the roller support member, this configuration can contribute to achieve a low profile apparatus housing.

According to a third aspect of the invention, in the recording apparatus of the second aspect, the slider extends in the rotation axis direction of the second roller and is positioned under the roller support member on a bottom of an apparatus housing.

According to the third aspect, since the slider extends in the rotation axis direction of the second roller and is positioned under the roller support member on a bottom of an apparatus housing, this configuration utilizes a space at the bottom of the apparatus housing which tends to be a dead space, thereby contributing to achieve a low profile apparatus housing.

According to a fourth aspect of the invention, in the recording apparatus of any one of the first aspect to the third aspect, a biasing unit that is capable of switching between a state in which the slider is biased in one direction of the displacement directions of the slider and a state in which the slider is biased in the other direction of the displacement directions of the slider is provided so that the slider is positioned at one of two positions in a displacement directions of the slider.

According to the fourth aspect, the slider can be positioned at one of two positions with a simple configuration, thereby achieving a function to transport the recording target nipped between the first roller and the second roller to the recording unit and a function to easily remove the recording target by retaining the second roller to be released from the first roller.

According to a fifth aspect of the invention, in the recording apparatus of any one of the first aspect to the fourth aspect, the slider is configured to be operated from an outside of the apparatus housing.

According to the fifth aspect, the jammed recording target can be easily removed by moving the driven roller away from the driving roller in the transportation unit through an operation from the outside of the apparatus without accessing the inside of the apparatus.

BRIEF DESCRIPTION OF THE DRAWINGS

The invention will be described with reference to the accompanying drawings, wherein like numbers reference like elements.

12A and 12B are perspective views of the gripper of the slider which is pulled laterally from the apparatus housing as seen from obliquely above and below, respectively.

Figure 13:
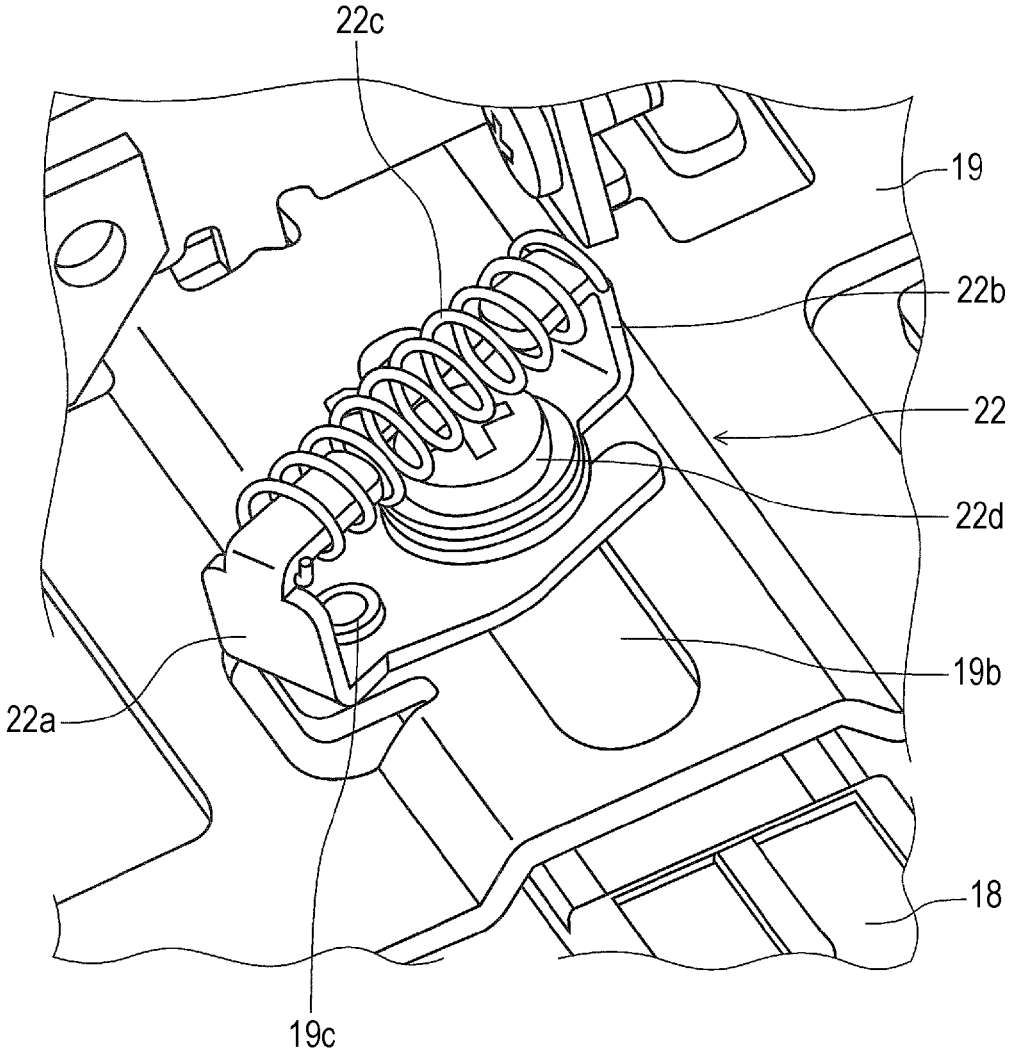

FIG. 13 is a perspective view of the biasing unit that is capable of holding the slider at each stroke end in two directions.

DESCRIPTION OF EXEMPLARY EMBODIMENTS

An embodiment of the invention will be described below with reference to the drawings. The invention is not limited to the embodiment described below and various modifications are possible and are contemplated as being within the scope of the invention as defined in the claims.

Figure 1:
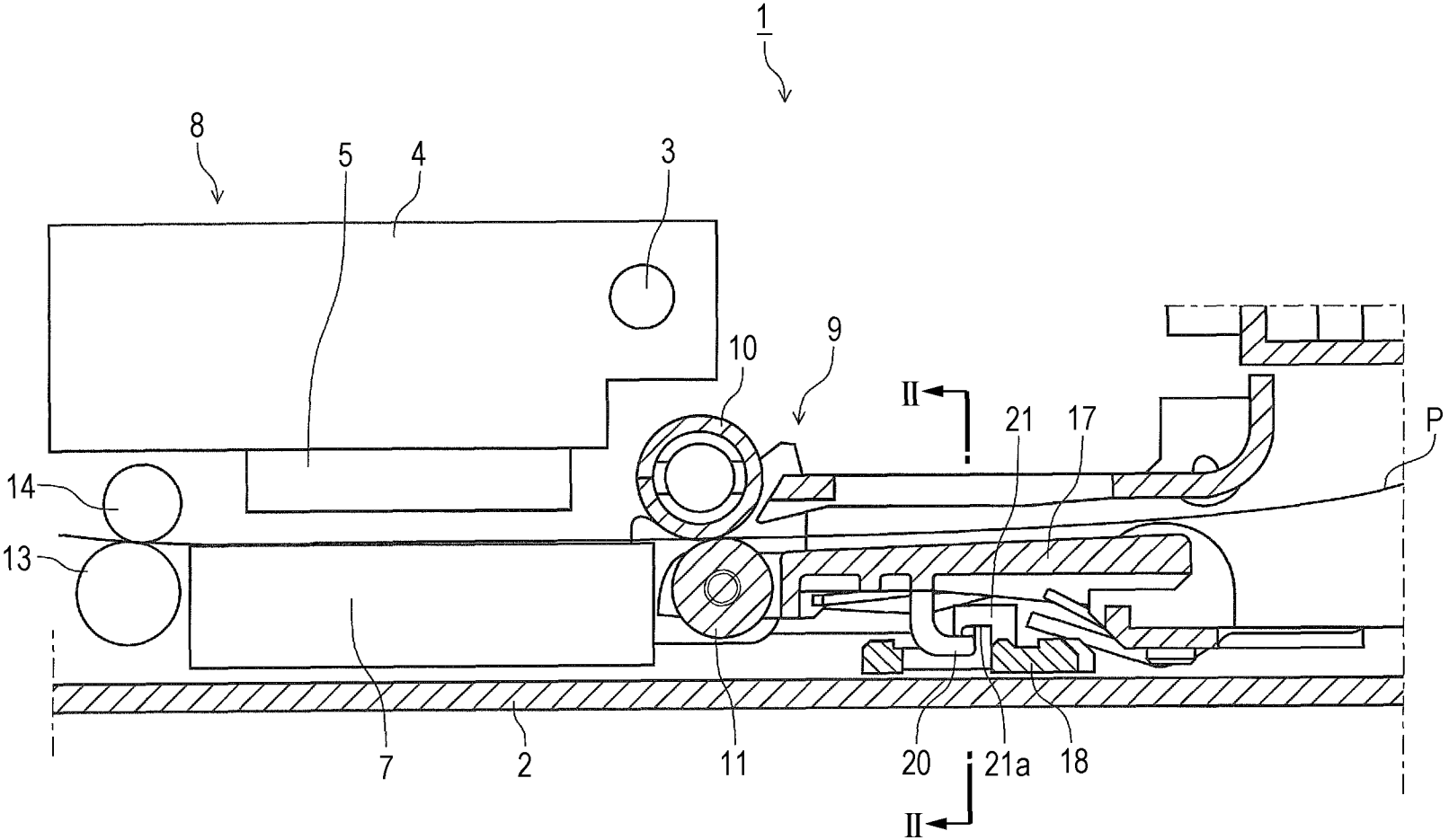
FIG. 1 is an essential vertical sectional view of a printer according to the invention in a paper sheet transportation direction.

FIG. 1 is an essential vertical sectional view of an ink jet printer (hereinafter, referred to as "printer") 1 which is one embodiment of a "recording apparatus" according to the invention. As shown in FIG. 1, the printer 1 includes a recording head 5 and a platen 7 in an apparatus housing 2. The recording head 5 is mounted on the underside of a carriage 4 that is supported by a carriage guide shaft 3 so as to perform recording by ejecting ink onto a paper sheet (recording target) P. The platen 7 is disposed at a position below and opposite the recording head 5 and defines a gap between a head surface of the recording head 5 and a paper sheet P. Further, ink cartridges (which are not shown in the figure) are loaded in the carriage 4. The carriage guide shaft 3 is configured to reciprocate in a direction perpendicular to the plane of FIG. 1 (hereinafter, referred to as a first direction, so-called main scan direction).

The printer 1 performs recording on the paper sheet P by alternatively repeating a paper sheet transportation operation in which the paper sheet P is transported by a predetermined distance in the right to left direction in FIG. 1 (hereinafter, referred to as a second direction, so-called sub-scan direction) between the head surface of the recording head 5 which is a recording unit and the platen 7, and an ink ejection operation in which ink is ejected from the recording head 5 onto the paper sheet P while the recording head 5 moves in the first direction (main scan direction).

A paper sheet transportation unit 9 includes a first roller 10 which is a driving roller disposed at an upper position and a second rollers 11 which is a driven roller disposed at a lower position. The rollers 10 and 11 pinch the paper sheet P therebetween and rotate so as to precisely feed the paper sheet P to the recording unit 8.

A third roller 13 which is a driving roller disposed at a lower position and a fourth roller 14 which is a driven roller disposed at an upper position are provided downstream relative to the recording unit 8. When the paper sheet P is transported between the recording head 5 and the platen 7 of the paper sheet transportation unit 9, the rollers 13 and 14 feed the paper sheet P to the outside of the apparatus at a speed synchronized with a transportation speed of the paper sheet transportation unit 9.

The printer 1 further includes a paper sheet feeding unit, which is not shown in the figure, at the upper right position relative to the paper sheet transportation unit 9 so as to feed the paper sheet P to the paper sheet transportation unit 9. The paper sheet feeding unit includes, for example, a feeding roller and a hopper, which are not shown in the figure.

Figure 2:
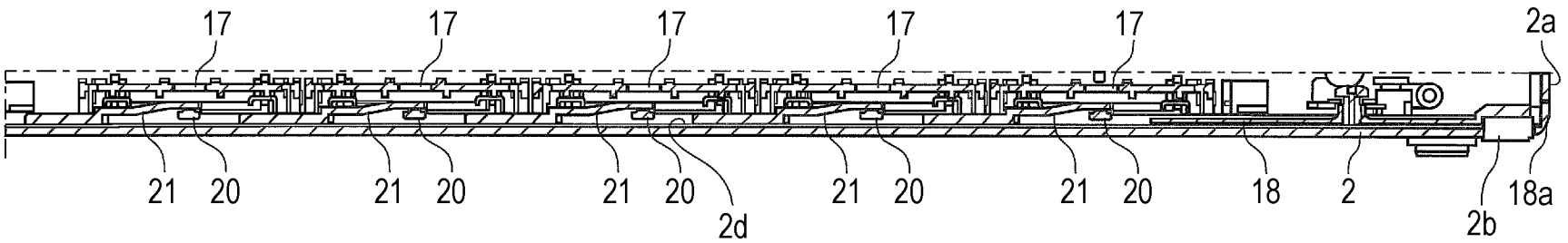
FIG. 2 is an essential sectional view of the printer during printing as seen in a paper sheet width direction taken along the line II-II of FIG. 1.
Figure 3:
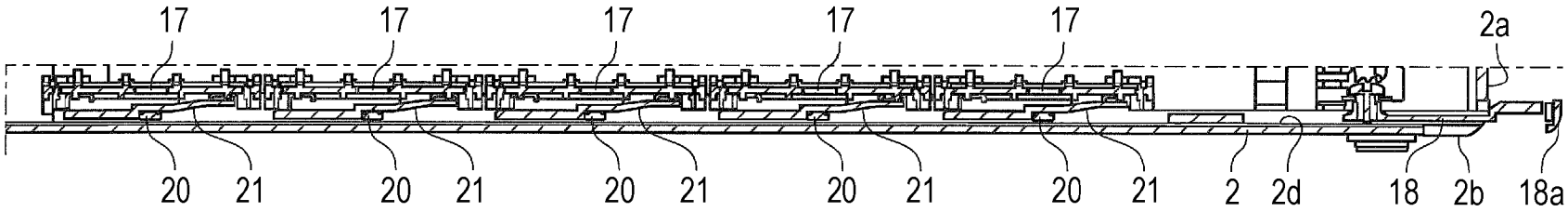
FIG. 3 is an essential sectional view of the printer when a jammed paper sheet is removed as seen in the paper sheet width direction taken along the line II-II of FIG. 1.
Figure 4:
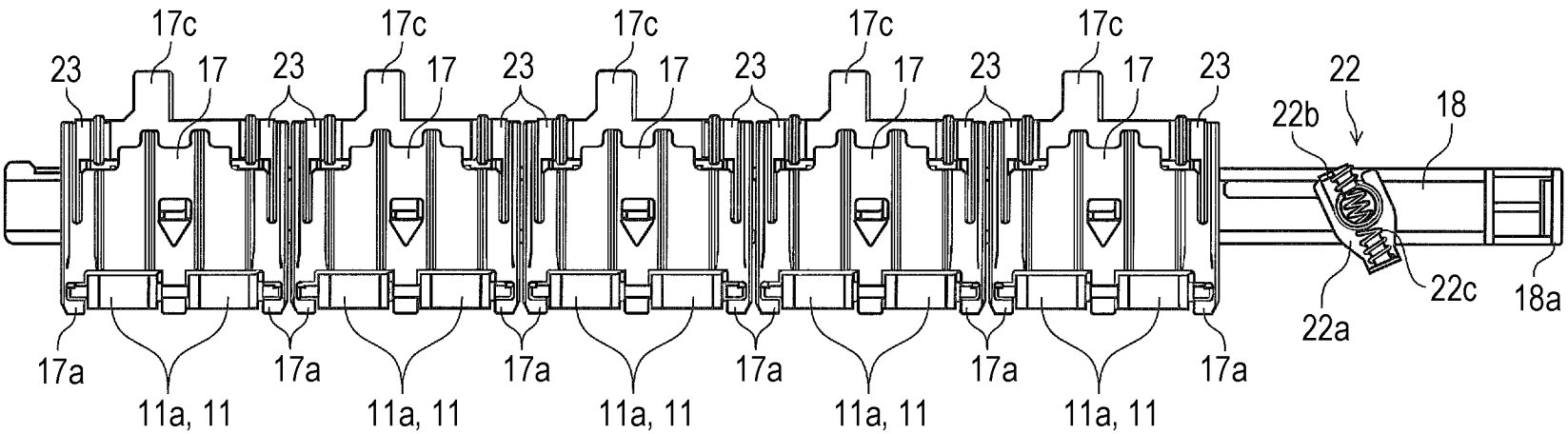
FIG. 4 is a plan view of an assembly of a second roller, roller support members and a slider.
Figure 5:
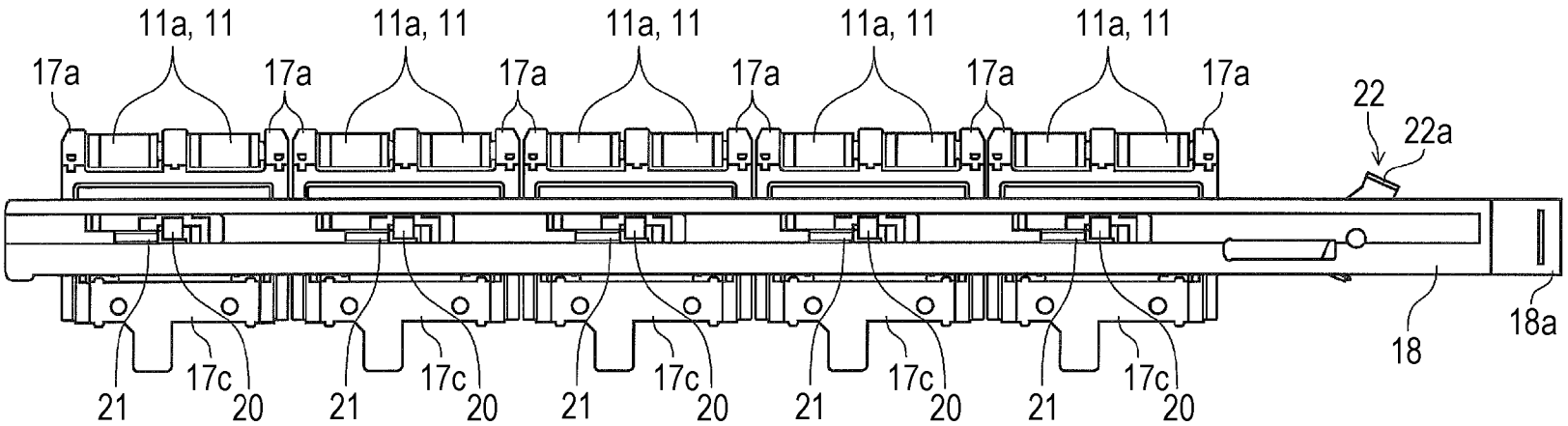
FIG. 5 is a bottom view of the assembly of FIG. 4.
Figure 6:
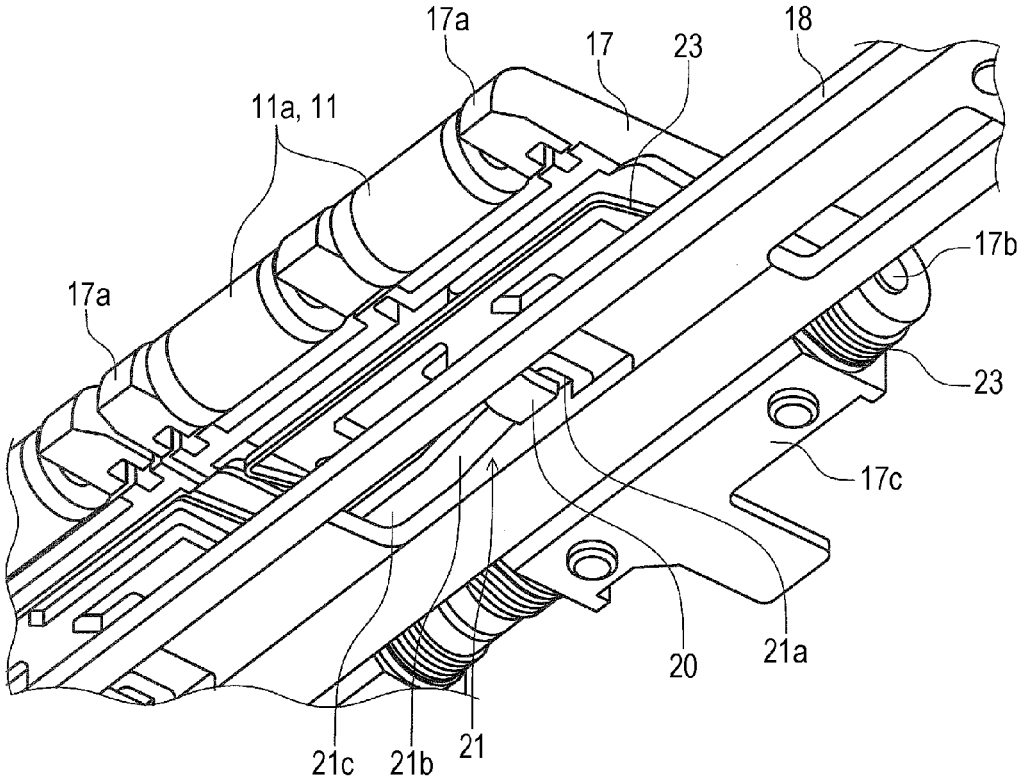
FIG. 6 is an enlarged partial perspective view of the assembly of FIG. 4 as seen from the bottom side.
Figure 7:
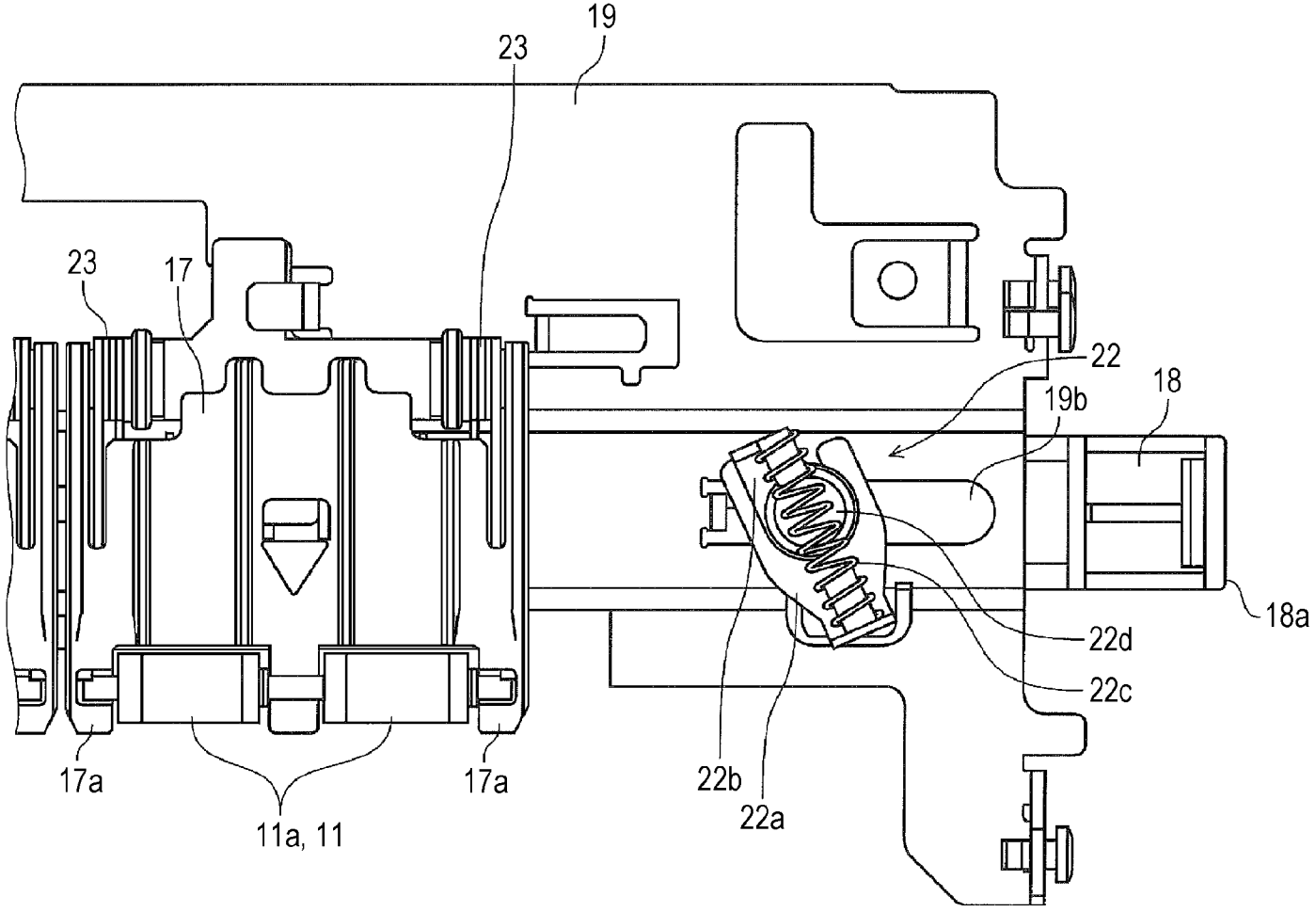
FIG. 7 is a partial plan view of an assembly of the slider, a slider guide, the roller support member and a biasing unit which shows that the biasing unit locks the slider when a transportation unit allows for transportation of a paper sheet.
Figure 8:
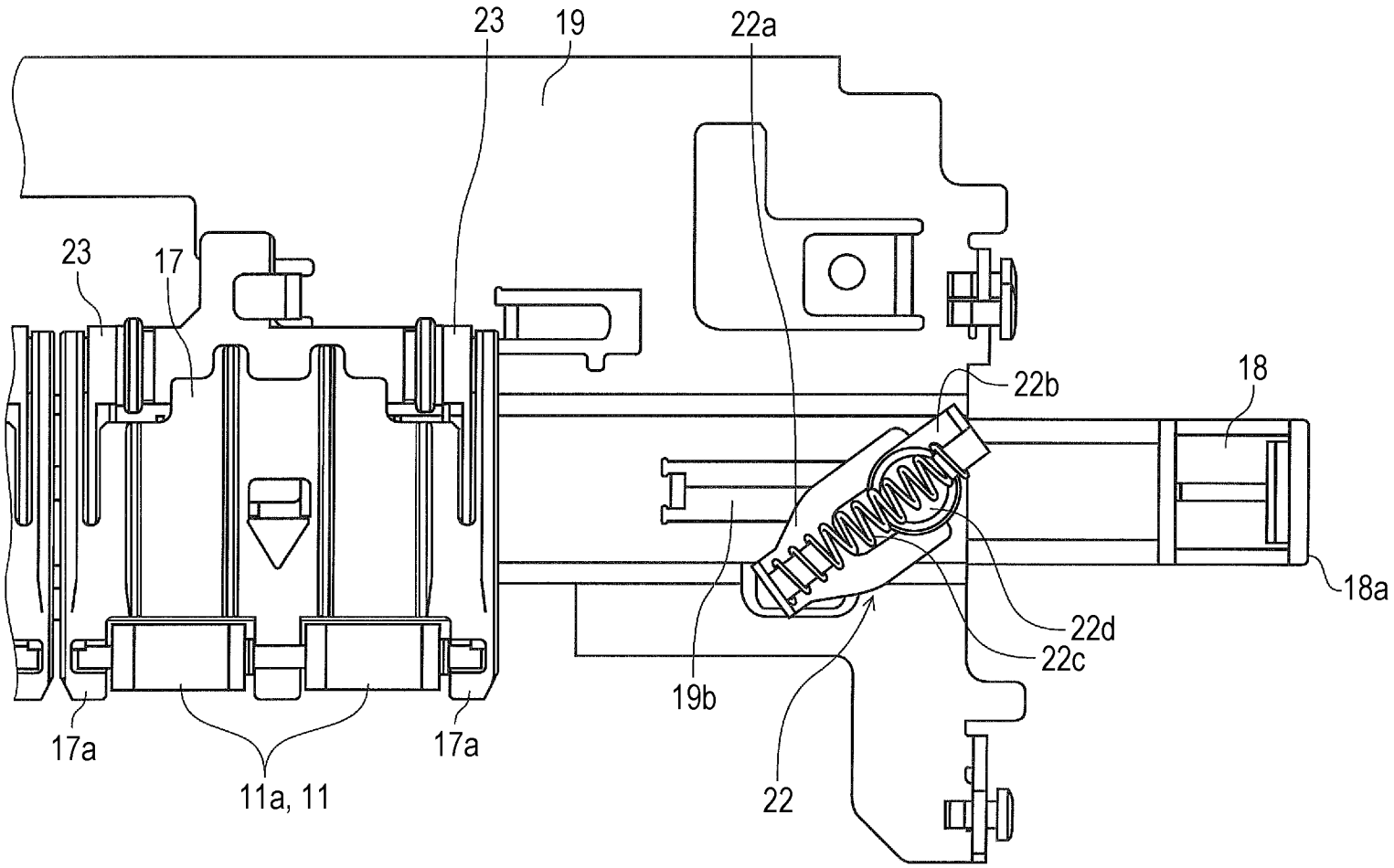
FIG. 8 is a partial plan view of the assembly of FIG. 7 which shows that the biasing unit locks the slider when a jammed paper sheet is removed.

FIG. 2 is a sectional view of the printer 1 during printing as seen in a paper sheet width direction taken along the line II-II of FIG. 1. FIG. 3 is a sectional view of the printer 1 when a jammed paper sheet P is removed as seen in the paper sheet width direction taken along the line II-II of FIG. 1. FIGS. 4 and 5 are a plan view and a bottom view, respectively, of an assembly of the second roller 11, roller support members 17 and a slider 18. FIG. 6 is an enlarged partial perspective view of the assembly. FIGS. 7 and 8 are plan views of the assembly further including a slider guide 19.

Figure 9:
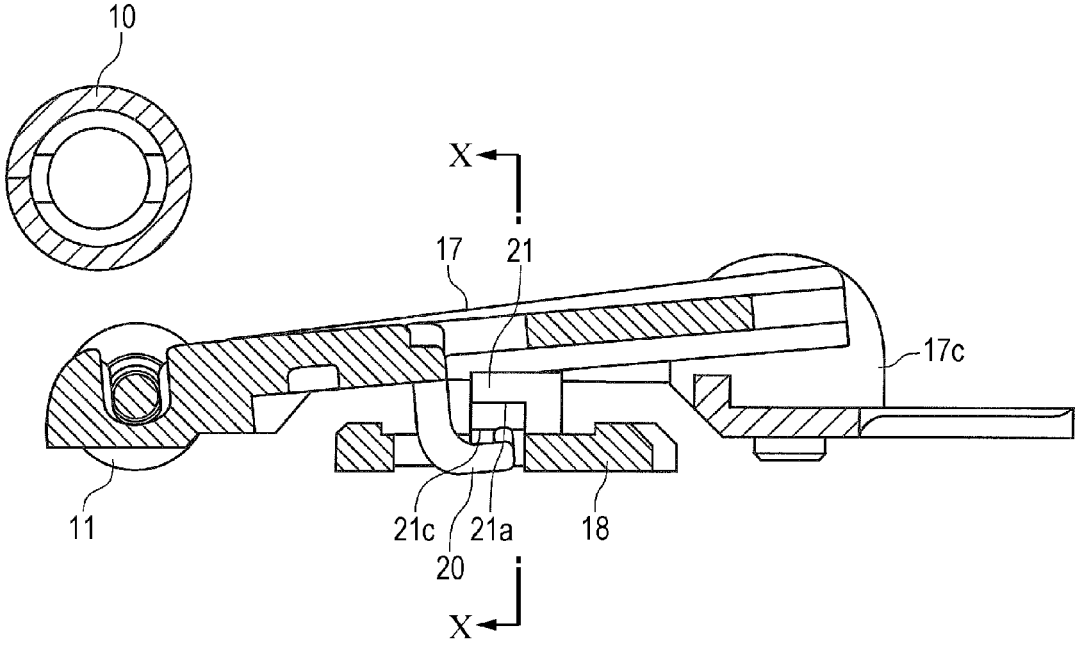
FIG. 9 is an essential vertical sectional view of the printer of FIG. 1 when a paper sheet jammed in the transportation unit is removed as seen in the paper sheet width direction.
Figure 10:
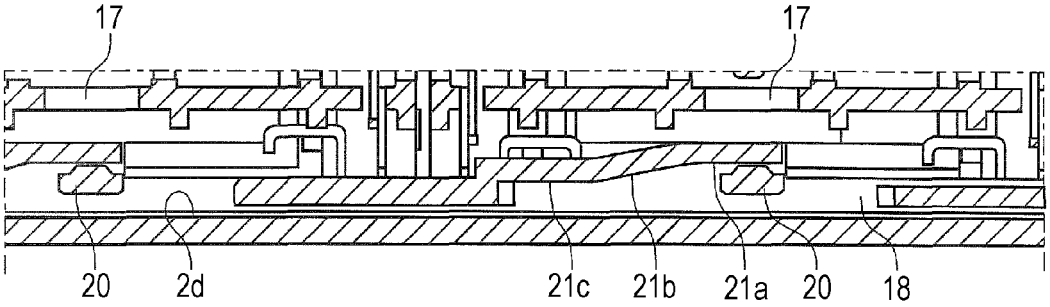
FIG. 10 is a sectional view taken along the line X-X of FIG. 9.

FIGS. 6 and 7 show that a biasing unit 22 locks the slider 18 when the transportation unit allows for transportation of the paper sheet P. FIG. 8 shows that the biasing unit 22 holds the slider 18 when a jammed paper sheet P is removed. FIG. 9 is an essential vertical sectional view of the printer when the paper sheet P jammed in the transportation unit is removed as seen in the paper sheet width direction. FIG. 10 is a sectional view taken along the line X-X of FIG. 9.

As shown in FIGS. 1 to 3, the slider 18 extends in the axis direction of the second roller 11 and includes linear cams 21. Each linear cam 21 has an inclined surface (inclined surface 21*b* which will be described below) that corresponds to each of a plurality of short rollers 11*a* which constitute the second roller 11 so as to change the height in the length direction, and horizontal surfaces (an upper horizontal surface 21*a* and a lower horizontal surface 21*c* which will be described below) on each side of the inclined surface. Further, a gripper 18*a* is formed on one end of the slider 18.

Figure 11A:
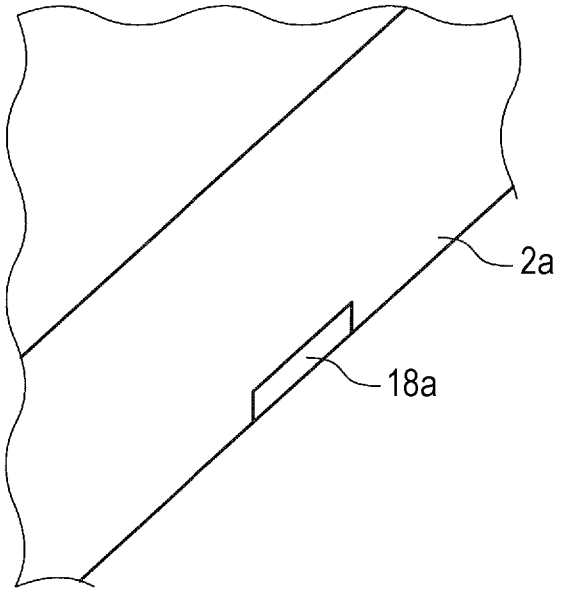
FIGS. 11A and 11B are perspective views of a gripper of the slider which is housed in an apparatus housing as seen from obliquely above and below, respectively.
Figure 11B:
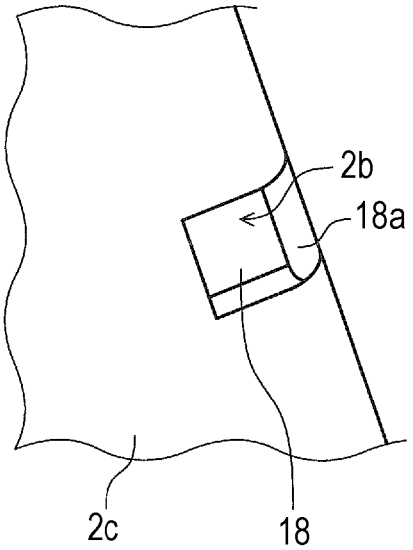
Figure 12A:
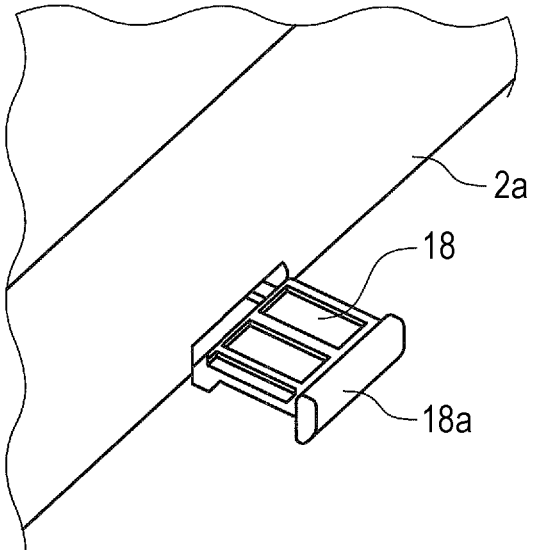
Figure 12B:
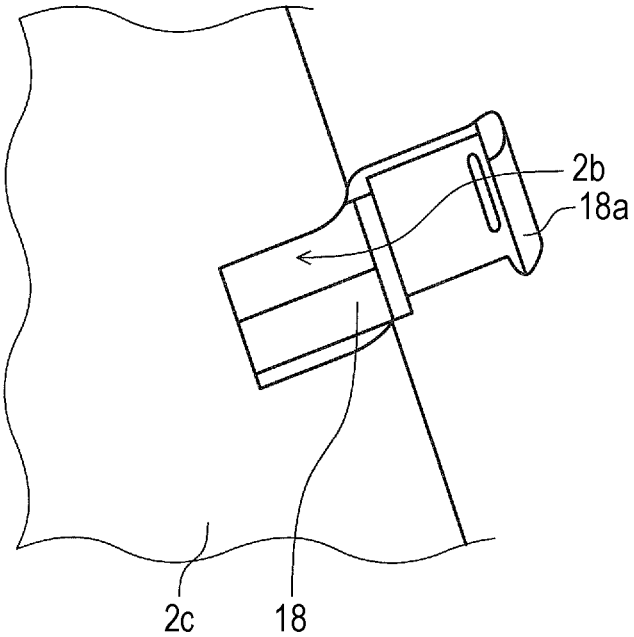

FIGS. 11A and 11B are perspective views of the gripper 18*a* of the slider 18 which is housed in the apparatus housing 2 as seen from obliquely above and below, respectively. FIGS. 12A and 12B are perspective views of the gripper 18*a* of the slider 18 which is pulled laterally from the apparatus housing 2 as seen from obliquely above and below, respectively. FIG. 13 is a perspective view of the biasing unit 22 that is capable of holding the slider 18 at each stroke end in two directions.

As shown in FIGS. 2, 3, 11A, 11B, 12A and 12B, the slider 18 generally extends on the bottom surface of the apparatus housing 2 (inside bottom surface of the housing), and the gripper 18*a* is configured to fit in a cutout 2*b* formed at a position from the bottom surface to the side surface of the apparatus housing 2. Reference numerals 2*a* and 2*c* indicate the side surface and the bottom surface of the housing, respectively.

When a paper jam occurs, a user pulls out the gripper 18*a* of the slider 18 with his/her finger thereby moving the second roller 11 downward away from the first roller 10. The effect of the slider 18 will be described later.

As shown in FIGS. 7 and 8, the slider guide 19 is fixedly attached on the bottom surface 2*d* of the apparatus housing 2 by screws (not shown in the figure). The slider guide 19 covers the slider 18 so that the slider 18 is housed on the underside of the slider guide 19, and guides the slider 18 in a slide direction.

As shown in FIGS. 4 and 5, the second roller 11 is composed of the plurality of short rollers 11*a* arranged on the axis line. The plurality of short rollers 11*a* are configured to move from the lower position so as to come into contact with the first roller 10 which is a single roller disposed at a fixed position and is rotated by a control motor (not shown in the figure) (see FIGS. 1 and 9).

As shown in FIGS. 4 to 8, a plurality of roller support members 17 are provided to correspond to two short rollers 11*a*. The roller support members 17 have beams 17*a* so as to support each end of a pair of short rollers 11*a*.

Since each end of the roller support members 17 fits on a shaft 17*b* which is disposed in a bearing bracket 17*c* as shown in FIG. 6, the roller support members 17 are pivotally movable about the shaft 17*b*.

As shown in FIGS. 4 to 8, torsion coil springs 23 are disposed on each end of the bearing bracket 17*c*. The torsion coil springs 23 bias the roller support members 17 in a direction in which the short rollers 11*a* come into pressing contact with the first roller 10.

As shown in FIGS. 1 to 3, 9 and 10, the roller support members 17 further include an engagement element 20 as an integrally formed arm that extends from the underside of the roller support member 17 at a substantially middle position between the beam 17*a* and the shaft 17*b*. The engagement elements 20 correspond to the linear cams 21 that are formed on the slider 18 and have a cam surface facing downward. The respective engagement elements 20 are positioned under the corresponding linear cams 21.

Each linear cam 21 has the lower horizontal surface 21*c*, the upper horizontal surface 21*a* and the inclined surface 21*b* that connects the lower horizontal surface 21*c* and the upper horizontal surface 21*a*. As the linear cams 21 slide (that is, the slider 18 slides), the respective engagement elements 20 oppose (abut) the lower horizontal surfaces 21*c* or oppose (abut) the inclined surfaces 21*b* or oppose the upper horizontal surfaces 21*a*.

When the gripper 18*a* of the slider 18 is housed in the apparatus housing 2 so as to form a flat surface with the side surface of the apparatus housing 2 (FIGS. 1, 2, 4 to 7, 10, 11A, 11B and 13), the upper ends of the engagement elements 20 oppose the upper horizontal surfaces 21*a* of the linear cams 21, which causes the roller support members 17 to be raised by the torsion coil springs 23, thereby allowing the second roller 11 to be in contact with the first roller 10. Further, when the engagement elements 20 oppose the upper horizontal surfaces 21*a*, it is preferable that the engagement elements 20 are not in contact with the upper horizontal surfaces 21*a*, because contact of the engagement elements 20 with the upper horizontal surfaces 21*a* has an effect on pressing contact of the second roller 11 with the first roller 10. The engagement elements 20 may be in contact with the lower horizontal surfaces 21*c*.

When the slider 18 slides and the gripper 18*a* of the slider 18 is pulled out from the side surface of the apparatus housing 2 (FIGS. 3, 7, 8, 9, 12A and 12B), the engagement elements 20 move on the inclined surfaces 21*b* of the linear cams 21 to engage with the lower horizontal surfaces 21*c*. That is, the engagement elements 20 come into contact with the inclined surfaces 21*b* of the linear cams 21 and then are moved down by the inclined surfaces 21*b*. This causes the roller support members 17 to resist the biasing force of the torsion coil springs 23 and rotate downward, thereby allowing the second roller 11 to move away from the first roller 10.

Accordingly, by operating the gripper 18*a* of the slider 18, the roller support members 17 can be pivotally moved between upper and lower positions and the second roller 11 can be moved between a state in which the second roller 11 is in contact with the first roller 10 and a state in which the second roller 11 is moved away from the first roller 10.

FIG. 13 is an enlarged perspective view of the biasing unit 22. The biasing unit 22 includes a first bracket 22*a*, a second bracket 22*b*, a compression coil spring 22*c* and a bracket mounting screw 22*d*. As shown in FIGS. 7, 8 and 13, the biasing unit 22 is assembled to both the slider guide 19 that is fixedly attached to the bottom of the apparatus housing 2 and the slider 18.

The first bracket 22*a* is pivotally movable about a shaft 19*c* of the slider guide 19 and is connected to the slider 18 via the bracket mounting screw 22*d*. Further, the first bracket 22*a* and the slider 18 are relatively rotatable about the bracket mounting screw 22*d*. A slot hole 19*b* that extends in the slide direction of the slider 18 is formed on the slider guide 19 such that the bracket mounting screw 22*d* is displaceable within the slot hole 19*b*. Accordingly, when the slider 18 slides, the first bracket 22*a* is pivotally movable about the shaft 19*c* while maintaining connection of the slider 18 and the first bracket 22*a*.

Similarly to the first bracket 22*a*, the second bracket 22*b* is connected to the slider 18 via the bracket mounting screw 22*d*. Further, the second bracket 22*b* and the slider 18 are also relatively movable about the bracket mounting screw 22*d*.

The compression coil spring 22*c* is disposed between the first bracket 22*a* and the second bracket 22*b*. A biasing force is applied to the second bracket 22*b* by the first bracket 22*a* via the compression coil spring 22*c*. When the gripper 18*a* of the slider 18 is housed in the side surface of the apparatus housing 2 (when the second roller 11 is in contact with the first roller 10), a biasing force in the upper left direction of FIG. 7 is applied to the second bracket 22*b* as shown in FIG. 7. As a result, since a force in the upper left direction of FIG. 7 is applied to the slider 18, a state that the gripper 18*a* is housed in the side surface of the apparatus housing 2 is stably maintained.

When the gripper 18*a* is pulled out by a user and the slider 18 slides, the direction of a biasing force applied to the second bracket 22*b* changes as shown in FIG. 8, specifically, the biasing force changes to the upper right direction of FIG. 8. As a result, since the biasing force in the upper right direction of FIG. 8 is applied to the slider 18, a state that the gripper 18*a* is pulled out from the side surface of the apparatus housing 2 is stably maintained. Accordingly, the biasing unit 22 changes the biasing direction of the slider 18 by pivotally moving about substantially the center of the sliding area in the slot hole 19*b* of the bracket mounting screw 22*d*.

As described above, the slider 18 that performs linear movement instead of a cam that performs circular movement is used to change the position of the roller support members 17 so as to change the position of the second roller 11 to the first roller 10 between a first state (contact state) and a second state (released state). As a result, the components can be installed in a low-height space, which contributes to achieve a low profile apparatus housing 2. Although the slider 18 linearly displaces along the rotation axis of the second roller 11 in this embodiment, the invention is not limited thereto, and the slider 18 may linearly displace in other directions.

Further, the apparatus housing 2 often has a dead space under the transportation unit. In this embodiment, the first roller 10 is a driving roller and the second roller 11 is a driven roller that comes into contact with the first roller 10 from the lower position. That is, the slider 18 can be positioned in the dead space, since the first roller 10 which is the driving roller is disposed at an upper position and the second roller 11 which is a driven roller is disposed at a lower position.

Specifically, in this embodiment, the slider 18 extends in the rotation axis direction of the second roller 11 and is positioned under the roller support members 17 on the bottom of the apparatus housing 2. In addition to use of the slider 18 to change the position of the roller support members 17, this configuration can contribute to achieve a low profile apparatus housing.

Further, in this embodiment, the biasing unit (biasing direction changing unit) 22 is capable of biasing the slider 18 in one direction or the other direction of the displacement directions of the slider 18 so that the slider 18 is positioned at one of two positions in a displacement directions of the slider 18. Accordingly, the slider 18 can be positioned at one of two positions with a simple configuration, thereby achieving a function to transport the paper sheet P nipped between the first roller 10 and the second roller 11 to the recording unit and a function to easily remove the paper sheet P by retaining the second roller 11 to be released from the first roller 10.

Further, in this embodiment, the slider 18 is configured to be operated from the outside of the apparatus housing 2. Accordingly, when a paper jam occurs, the jammed paper sheet P can be removed by moving the second roller 11 away from the first roller 10 through an operation from the outside of the apparatus without accessing the inside of the apparatus.

The entire disclosure of Japanese Patent Application No. 2012-104468, filed May 1, 2012, is expressly incorporated by reference herein.

What is claimed is:

1. A recording apparatus comprising:

a first roller;

a second roller that comes into contact with the first roller;

a roller support member that supports the second roller and is capable of switching between a first state in which the second roller is in contact with the first roller and a second state in which the second roller is moved away from the first roller;

a slider that extends in a rotation axis direction of the second roller, is linearly displaceable and engages the roller support member so as to perform switching by the roller support member;

a first biasing unit that biases the roller support member to be in the first state that the second roller is in contact with the first roller; and a gripping portion that is formed on one end side of the slider, and is displaced from a first position that is positioned at a side surface of an apparatus housing to a second position that is extended outside of the apparatus housing, wherein the slider includes a cam which has a first surface and a second surface, wherein the roller support member includes an engagement element which engages the cam, wherein when the gripping portion is positioned at the first position, the engagement element engages the first surface of the cam and the second roller is in contact with the first roller by the biasing force of the first biasing unit, and wherein when the gripping portion is positioned at the second position, the engagement element engages the second surface of the cam and the second roller is moved away from the first roller while the second roller resists the biasing force of the first biasing unit.

2. The recording apparatus according to claim 1, wherein the first roller is a driving roller and the second roller is a driven roller that comes into contact with the first roller from the lower position.

3. The recording apparatus according to claim 2, wherein the slider is positioned under the roller support member on a bottom of an apparatus housing.

4. The recording apparatus according to claims 1, wherein a second biasing unit that is capable of switching between a state in which the slider is biased in one direction of a displacement directions of the slider and a state in which the slider is biased in the other direction of the displacement directions of the slider is provided so that the slider is positioned at one of two positions in the displacement directions of the slider.

5. The recording apparatus according to claims 1, wherein the slider is configured to be operated from an outside of the apparatus housing.

6. The recording apparatus according to claim 1, wherein when the first roller is disposed at an upper position and the second roller is disposed at a lower position, in the second state, the second roller moves downward from the first roller.

7. The recording apparatus according to claim 6, wherein the first roller and the second roller feed a recording medium to a recording unit.

* * * * *